US007867683B2

(12) United States Patent
Ninomiya et al.

(10) Patent No.: US 7,867,683 B2
(45) Date of Patent: Jan. 11, 2011

(54) TONER, METHOD OF PRODUCING THE SAME, DEVELOPER, AND IMAGE FORMING APPARATUS

(75) Inventors: Masanobu Ninomiya, Minamiashigara (JP); Toyofumi Inoue, Minamiashigara (JP); Masataka Kuribayashi, Minamiashigara (JP); Masashi Ikeda, Minamiashigara (JP); Takafumi Koide, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 883 days.

(21) Appl. No.: 11/785,877

(22) Filed: Apr. 20, 2007

(65) Prior Publication Data

US 2008/0085460 A1 Apr. 10, 2008

(30) Foreign Application Priority Data

Oct. 4, 2006 (JP) ..... 2006-273165

(51) Int. Cl.
*G03G 9/00* (2006.01)

(52) U.S. Cl. ..... 430/111.4; 430/109.1; 430/109.4; 430/111.35; 430/137.1; 430/137.14

(58) Field of Classification Search ..... 430/111.4, 430/109.1, 109.4, 111.35, 137.1, 137.14
See application file for complete search history.

(56) References Cited

U.S. PATENT DOCUMENTS

| | | | | |
|---|---|---|---|---|
| 5,955,234 | A | 9/1999 | Matsunaga et al. | |
| 7,374,854 | B2 * | 5/2008 | Ninomiya et al. | 430/123.4 |
| 2003/0224278 | A1 | 12/2003 | Shirai et al. | |

FOREIGN PATENT DOCUMENTS

| | | |
|---|---|---|
| EP | 1 703 333 A1 | 9/2006 |
| JP | A 04-239021 | 8/1992 |
| JP | A-10-171156 | 6/1998 |
| JP | A-2002-287425 | 10/2002 |
| JP | A-2004-151638 | 5/2004 |
| JP | A-2004-264803 | 9/2004 |
| JP | A-2005-77784 | 3/2005 |
| JP | A-2006-259431 | 9/2006 |

OTHER PUBLICATIONS

Oct. 19, 2010 Japanese Office Action issued in Japanese Patent Application No. 2006-273165 (with translation).

* cited by examiner

*Primary Examiner*—Mark A Chapman
(74) *Attorney, Agent, or Firm*—Oliff & Berridge, PLC

(57) ABSTRACT

A toner that when the complex elastic modulus measured at an angular frequency of 6.28 rad/sec., and a strain amount of 0.3% is $1\times10^6$ Pa or more and $1\times10^8$ Pa or less, the tangent loss is 0.5 or more and 1.8 or less.

17 Claims, 4 Drawing Sheets

TONER, METHOD OF PRODUCING THE SAME, DEVELOPER, AND IMAGE FORMING APPARATUS

This application is based on and claims priority under U.S.C. 119 from Japanese Patent Application No. 2006-273165 filed Oct. 4, 2006.

BACKGROUND (i) Technical Field

The present invention relates to a toner, a method of producing the toner, a developer containing the toner, and an image forming apparatus using the toner.

(ii) Related Art

Hitherto, in electrophotography, a developed image has been generally obtained by forming an electrostatic latent image on an electrified photosensitive body, and then developing the electrostatic latent image with a developer containing an electrostatic image developing toner stirred and held by a developing unit. Finally, this developed image is transferred onto a transferred object such as paper and then heated by a fixing member, to be fixed onto the body.

The fixing temperature which is a temperature when the developed image is fixed onto the transferred object is desired to be made lower in order to save electric power, shorten the time period when the temperature of the fixing member is raised, prolong the lifespan of the fixing member, and attain others. In order to realize this, it can be conceived to set, into a low value, the glass transition temperature of a non-crystalline resin which is a primary component of conventional toner. At the same time, however, the toner may become soft and particles of the toner may aggregate easily.

SUMMARY

In light of the above-mentioned situation, the invention provides: a toner wherein: when the complex elastic modulus measured at an angular frequency of 6.28 rad/sec., and a strain amount of 0.3% is $1\times10^6$ Pa or more and $1\times10^8$ Pa or less, the tangent loss is 0.5 or more and 1.8 or less.

BRIEF DESCRIPTION OF THE DRAWINGS

Exemplary embodiments of the present invention will be described in detail based on the following figures, wherein.

DETAILED DESCRIPTION

Figure 1:
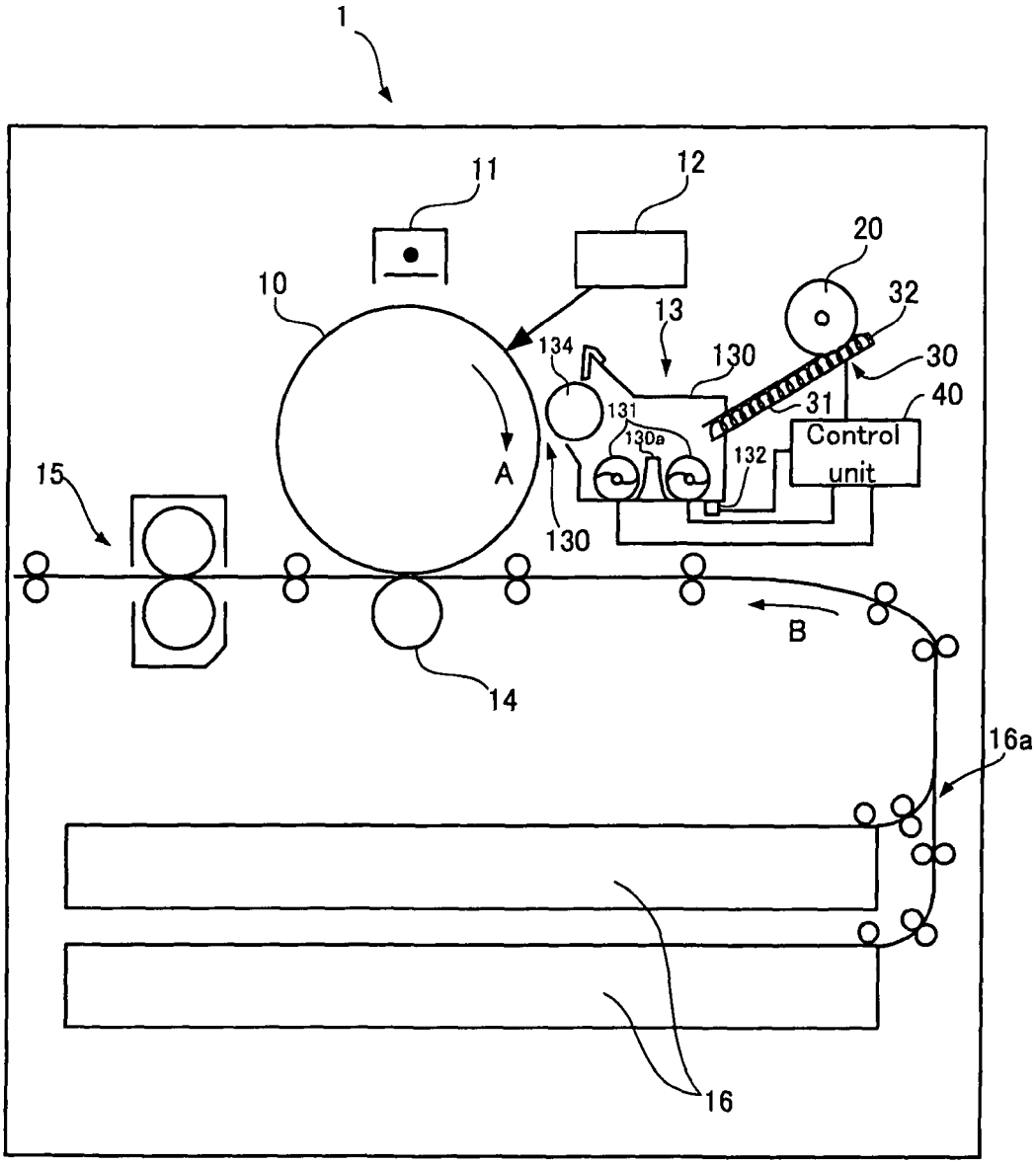
FIG. 1 is a schematic structural view of an embodiment of the image forming apparatus of the invention.

An exemplary embodiment of the invention will be described below.

Materials, which constitute a toner, may be, for example, the following materials.

The electrostatic latent image developing toner (hereinafter, also may be sometimes referred to as "toner") in the present exemplary embodiment of the invention may be a toner containing a non-crystalline resin, a crystalline resin, and a release agent.

The electrostatic latent image developing toner in the present exemplary embodiment is preferably a toner wherein the acid value of the crystalline resin is 5 to 50 mgKOH/g, the acid value of the non-crystalline resin is 10 to 50 mgKOH/g, the melting temperature of the crystalline resin is 50 to 100° C. in accordance with ASTM D3418-8, the weight-average molecular weight (Mw) of the crystalline resin is 8,000 to 35,000, the glass transition temperature (Tg) of the non-crystalline resin is 50 to 65° C. in accordance with ASTM D3418-8, the weight-average molecular weight (Mw) of the non-crystalline resin is 20,000 to 50,000, and the ratio by weight of the crystalline resin to the non-crystalline resin is 5/95 to 40/60.

—Crystalline Resin—

In the present specification, the wording "crystalline polyester resin" means any polyester resin which does not exhibit any stepwise change in endothermic amount but has a clear endothermic peak according to differential scanning calorimetry (DSC). The word "crystalline" related to the electrostatic latent image developing toner means that the DSC curve of the toner according to differential scanning calorimetry (DSC) has a clear endothermic peak, and specifically means that an endothermic peak is generated when the measurement is made at a temperature-raising rate of 10° C./min., and subsequently the line of measured data returns to the baseline of the DSC curve.

Specifically, the crystalline resin is more preferably an aliphatic crystalline polyester resin having an appropriate melting temperature and having an alkyl group having 6 or more carbon atoms. A polyester resin having an alkyl group having 6 or more carbon atoms can be obtained by use of a polymerizable monomer wherein a polycarboxylic acid or polyhydric alcohol having an alkyl group has 6 or more carbon atoms. The acid or alcohol is, for example, dodecenylsuccinic acid, but is not limited thereto.

Examples of the polycarboxylic acid, which is used to produce the resin used in the present exemplary embodiment, include aromatic dicarboxylic acids such as terephthalic acid, isophthalic acid, orthophthalic acid, 1,5-naphthalenedicarboxylic acid, 2,6-naphthalenedicarboxylic acid, and diphenic acid; aromatic oxycarboxylic acids such as p-oxybenzoic acid, and p-(hydroxyethoxy)benzoic acid; aliphatic dicarboxylic acids such as succinic acid, alkylsuccinic acid, alkenylsuccinic acid, adipic acid, azelaic acid, sebacic acid, and dodecane dicarboxylic acid; unsaturated aliphatic and alicyclic dicarboxylic acids such as fumaric acid, maleic acid, itaconic acid, mesaconic acid, citraconic acid, hexahydrophthalic acid, tetrahydrophthalic acid, dimer acid, trimer acid, hydrogenated dimer acid, cyclohexanedicarboxylic acid, and cyclohexene dicarboxylic acid; and trivalent or higher-valent polycarboxylic acids such as trimellitic acid, trimesic acid, and pyromellitic acid.

The polyhydric alcohols, which are used to produce the resin, are, for example, aliphatic polyhydric alcohols, alicyclic polyhydric alcohols, or aromatic polyhydric alcohols. Examples of the aliphatic polyhydric alcohol include aliphatic diols such as ethylene glycol, propylene glycol, 1,3-propanediol, 2,3-butanediol, 1,4-butanediol, 1,5-pentanediol, 1,6-hexanediol, neopentyl glycol, diethylene glycol, dipropylene glycol, dimethylolheptane, 2,2,4-trimethyl-1,3-pentanediol, polyethylene glycol, polypropylene glycol, polytetramethylene glycol, and lactone-based polyester polyols each obtained by subjecting a lactone such as ε-caprolactone to ring-opening polymerization; and triols and tetraols such as trimethylolethane, trimethylolpropene, glycerin, and pentaerythritol.

Examples of the alicyclic polyhydric alcohols include 1,4-cyclohexanediol, 1,4-cyclohexanedimethanol, spiroglycol, hydrogenated bisphenol A, ethylene oxide and propylene oxide adducts of hydrogenated bisphenol A, tricyclodecanediol, tricyclodecanedimethanol, dimerdiol, and hydrogenated dimerdiol.

Examples of the aromatic polyhydric alcohol include p-xylene glycol, m-xylene glycol, o-xylene glycol, 1,4-phenylene glycol, an ethylene oxide adducts of 1,4-phenylene glycol, bisphenol A, and ethylene oxide and propylene oxide adducts of bisphenol A.

In order to sequester a polar group at a terminal of the polyester resin to improve the environment stability of the charging characteristic of the toner, a monofunctional monomer may be introduced into the polyester resin. Examples of the monofunctional monomer include monocarboxylic acids and derivatives thereof, such as benzoic acid, chlorobenzoic acid, bromobenzoic acid, p-hydroxybenzoic acid, monoammonium sulfobenzoate, monosodium sulfobenzoate, cyclohexylaminocarbonylbenzoic acid, n-dodecylaminocarbonylbenzoic acid, tert-butylbenzoic acid, naphthalenecarboxylic acid, 4-methylbenzoic acid, 3-methylbenzoic acid, salicylic acid, thiosalicylic acid, phenylacetic acid, acetic acid, propionic acid, butyric acid, isobutyric acid, octane carboxylic acid, lauric acid and stearic acid, and lower alkyl esters thereof; and monohydric alcohols such as aliphatic alcohols, aromatic alcohols, and alicyclic alcohols.

The method of producing the crystalline resin is not particularly limited, and may be an ordinary polyester-producing polymerization method, wherein an acid component and an alcohol component are caused to react with each other. Examples thereof include a direct polycondensation method, and a transesterfication method. In accordance with the kind of the monomers to be used, an appropriate method is selected and used.

The crystalline resin can be produced at a polymerization temperature of 180 to 230° C. The pressure in the reaction system is reduced if necessary, and the starting monomers are caused to react with each other while water or any alcohol generated when the monomers are condensed is removed. When the monomers are not dissolved or dissolved into each other at the reaction temperature, a solvent having a high boiling temperature as a solubilizing agent may be added to the system to dissolve the monomers. The polycondensation reaction is conducted while the solubilizing agent is distilled off. In the case that a copolymerization reaction is conducted and a monomer poor in compatibility is present, it is preferred to condense the monomer poor in compatibility beforehand with an acid or alcohol which is to be polycondensed with the monomer, and then polycondense the primary component together with the condensed product.

At the time of producing the crystalline resin, a catalyst can be used, and examples of the catalyst include compounds of an alkali metal such as sodium or lithium; compounds of an alkaline earth metal such as magnesium or calcium; compounds of a metal such as zinc, manganese, antimony, titanium, tin, zirconium, or germanium; phosphorous acid compounds; phosphoric acid compounds; and amine compounds. Specific examples thereof include the following compounds:

sodium acetate, sodium carbonate, lithium acetate, lithium carbonate, calcium acetate, calcium stearate, magnesium acetate, zinc acetate, zinc stearate, zinc naphthenate, zinc chloride, manganese acetate, manganese naphthenate, titanium tetrabutoxide, titanium tetrapropoxide, titanium tetraisopropoxide, titanium tetrabutoxide, antimony trioxide, triphenylantimony, tributylantimony, tin formate, tinoxalate, tetraphenyltin, dibutyltindichloride, dibutyltin oxide, diphenyltin oxide, zirconium tetrabutoxide, zirconium naphthenate, zirconyl carbonate, zirconyl acetate, zirconyl stearate, zirconyl octanoate, germanium oxide, triphenylphosphite, tris(2,4-t-butylphenyl)phosphite, ethyltriphenylphosphonium bromide, triethylamine, and triphenylamine. The addition amount of such a catalyst is preferably 0.01 to 1.00% by mass of the whole of the starting materials.

The melting temperature of the crystalline resin is preferably 50 to 100° C., more preferably 60 to 100° C. If the melting temperature is lower than 50° C., a problem may be caused about the storability of the toner or the storability of a fixed image of the toner. On the other hand, if the melting temperature is higher than 100° C., the low-temperature fixability may not be sufficient as compared with that of conventional toners.

The crystalline resin may have plural melting peaks. In the invention, the maximum peak out of the peaks is defined as the melting temperature.

The melting temperature of the resins used in the invention can be measured by use of, for example, a calorimeter DSC-7 manufactured by PerkinElmer, Inc. For temperature correction in a detecting unit of this calorimeter, the melting temperature of indium and that of zinc are used. The glass transition temperature of the resins can be also measured in the same way.

The crystalline resin used in the toner of the present exemplary embodiment has a weight-average molecular weight (Mw) of 8,000 to 35,000, preferably 10,000 to 25,000 in accordance with molecular weight measurement of tetrahydrofuran (THF) soluble contents in the resin by gel permeation chromatography (GPC). If the weight-average molecular weight is less than 8,000, the compatibility of the crystalline resin with the non-crystalline resin or the release agent advances and plasticization may be caused. If the weight-average molecular weight is more than 35,000, the viscosity of the toner at the time when the toner is melted increases. Thus, the fixability or image gloss may be damaged. The molecular weight of the resin is calculated out by subjecting THF-soluble matters in the resin to molecular weight measurement in THF as a solvent by use of a column "TSKgel Super HM-M" (15 cm) manufactured by Tosoh Corp., and then using a molecular weight calibrating curve prepared on the basis of a mono-dispersed polystyrene standard sample. The molecular weight of the non-crystalline resin, which will be detailed later, is also measured in the same way.

In the toner of the present exemplary embodiment, the melting temperature (mp) of the crystalline resin is preferably 50 to 100° C., the melting temperature being measured in accordance with ASTM D3418-8. If the melting temperature is lower than 50° C., the thermal stability of the toner decreases. If the melting temperature is higher than 100° C., the glossiness of an image made of the toner at the time when the image is fixed decreases.

About the crystalline resin, the acid value (the weight [unit: mg] of KOH necessary for neutralizing one gram of the resin) is controlled into the range of 5 to 50 mgKOH/g. If the acid value is less than 5 mgKOH/g, particles of the crystalline resin form an aggregate. As a result, it becomes difficult that the crystalline resin particles are combined with the release agent to form a structural body. Additionally, the crystalline resin particles are independently present in the toner or grow into a large size, and thereby the particles expose their appearances onto the surface of the toner. This is not favorable from the viewpoint of the fluidity and the charging characteristic of the toner. If the acid value is more than 50 mgKOH/g, it may become difficult to enclose the crystalline resin particles into the toner.

—Non-Crystalline Polyester Resin—

The non-crystalline polyester resin is a resin obtained by polycondensing, mainly, the above-mentioned polycarboxylic acid and polyhydric alcohol by use of the above-mentioned catalyst.

The non-crystalline resin can be produced by subjecting the above-mentioned polyhydric alcohol and polycarboxylic acid to condensation reaction in accordance with an ordinary method. For example, the above-mentioned polyhydric alcohol and polycarboxylic acid are incorporated into a reaction vessel equipped with a thermometer, a stirrer, and a flow-down type condenser, in which a catalyst is put if necessary, heating the system at 150 to 250° C. under the presence of an inert gas (such as nitrogen), removing low molecular weight compounds as byproducts continuously out of the reaction system, stopping the reaction when the acid values reach predetermined values, cooling the system, and obtaining the target reaction product.

The glass transition temperature of the non-crystalline polyester resin used in the present exemplary embodiment is essentially 50° C. or higher when the temperature is measured in accordance with ASTM D3418-8. The glass transition temperature is preferably 55° C. or higher, more preferably 60° C. or higher and lower than 65° C. If the glass transition temperature is lower than 50° C., the resin tends to aggregate when the resin is handled or stored. Thus, a problem may be caused about the storage stability. If the temperature is 65° C. or higher, the fixability may unfavorably decrease.

The softening temperature of the non-crystalline resin used in the present exemplary embodiment is preferably 60 to 90° C. The toner containing the resin which has a softening temperature controlled to a temperature lower than 60° C. tends to aggregate when it is handled or stored. The fluidity deteriorates largely, in particular, when the toner is stored for a long term. If the softening temperature is higher than 90° C., a problem may be caused about the fixability. The material of a fixing roll to be used and the material of a substrate onto which an image is to be copied are limited since the fixing roll needs to be heated to high temperature.

About the non-crystalline polyester resin used in the toner of the invention, the weight-average molecular weight (Mw) thereof, which is according to measurement of tetrahydrofuran (THF) soluble contents in the resin by gel permeation chromatography (GPC), is 20,000 to 50,000, preferably 25,000 to 50,000. If the weight-average molecular weight is less than 25,000, the thermal storability of the toner decreases and further the strength of the fixed image decreases. If the weight-average molecular weight is more than 50,000, the fixability deteriorates and the glossiness of the image decreases.

The acid value of the non-crystalline polyester resin is preferably 10 to 50 mgKOH/g. If the acid value is less than 10 mgKOH/g, the particle size of aggregates grows speedily when the toner is produced. Thus, an inconvenience that the particle size distribution of the produced toner expands may be caused. If the acid value is more than 50 mgKOH/g, a difference thereof from the acid value of the crystalline resin or that of the release agent becomes large and thereby only aggregation between the non-crystalline resin and the crystalline resin or release agent may advance. Thus, an inconvenience that the fixability is varied between the toner particles is caused. The acid value of the non-crystalline polyester resin can be adjusted by controlling the carboxylic group at a terminal of the polyester by selecting the blend ratio and the reaction rate between the polycarboxylic acid and the polyhydric alcohol, which are the starting materials. Alternatively, when trimellitic anhydride is used as the polycarboxylic acid component, a polyester having, in the main chain thereof, one or more carboxylic acids can be obtained.

In the toner of the present exemplary embodiment, the ratio by weight of the crystalline resin to the non-crystalline resin is 5/95 to 40/60. If the ratio of the non-crystalline resin is less than 60%, the phase separation structure of the fixed image becomes uneven although a good fixability can be obtained. As a result, the strength of the fixed image, in particular, the scratch strength thereof decreases to cause a problem that the image is easily damaged. On the other hand, if the ratio is more than 95%, sharp meltability, originating from the crystalline resin, cannot be obtained, and therefore plasticization may be occasionally generated. Thus, it may be impossible that the toner blocking resistance or image storability is kept good while a good low-temperature fixability is surely kept.

A dispersion liquid of particles of the crystalline resin and the non-crystalline resin can be prepared by emulsifying and dispersing the particles by adjusting the acid values of the resins or using an ionic surfactant or the like.

In the case that the resins are produced by some other method and the resins are oily and can be dissolved in a solvent having a relatively low solubility in water, a dispersion liquid of particles of the resins can be prepared by dissolving the resins in the solvent, dispersing particles thereof together with an ionic surfactant and a polymeric electrolyte into water by means of a dispersing machine such as a homogenizer, and then heating the system or reducing the pressure therein to vaporize and scatter the solvent. The resin particle dispersion liquid may be prepared by a method of adding a surfactant to the resins, and emulsifying and dispersing the resins in water by means of a dispersing machine such as a homogenizer, or by a phase inversion emulsifying method.

The particle diameter of the thus-obtained resin particle dispersion liquid can be measured with, for example, a laser diffraction mode particle size distribution analyzer (trade name: LA-700, manufactured by Horiba, Ltd.).

—Release Agent—

Specific examples of the release agent used in the present exemplary embodiment include low molecular weight polyolefins such as polyethylene, polypropylene, and polybutene; silicones which exhibits a softening temperature by heating; aliphatic acid amides such as oleicamide, erucicamide, ricinoleicamide, and stearic amide; plant waxes such as carnauba wax, rice wax, candelilla wax, tallow, and jojoba oil; animal waxes such as beeswax; mineral/petroleum waxes such as montan wax, ozocerite, ceresin, paraffin wax, microcrystalline wax, and Fischer-Tropsch wax; ester waxes each made from a higher aliphatic acid and a higher alcohol, such as stearyl stearate, and behenyl behenate; ester waxes each made from a higher aliphatic acid and a monohydric or polyhydric lower alcohol, such as butyl stearate, propyl oleate, glyceride monostearate, glyceride distearate, and pentaerythritol tetrabehenate; ester waxes each made from a higher aliphatic acid and a polyhydric alcohol multimer, such as diethylene glycol monostearate, dipropylene glycol distearate, diglyceride distearate, and triglyceride tetrastearate; higher aliphatic acid sorbitan ester waxes such as sorbitan monostearate; and higher aliphatic acid cholesterol ester waxes such as cholesteryl stearate. In the present exemplary embodiment, these release agents may be used alone or in combination of two or more thereof. In the exemplary embodiment, compounds having a melting temperature of 40 to 120° C. are used out of these agents. In particular, compounds having a melting temperature of 50 to 100° C. are preferably used and compounds having a melting temperature of 50 to 80° C. are more preferably used to meet a demand of low-temperature fixability for energy saving demanded in recent years.

The addition amount of the release agent is preferably 0.5 to 30% by weight, more preferably 1 to 20% by weight, even more preferably 5 to 15% by weight with respect to the total amount of the toner. If the addition amount is less than 0.5% by weight, no advantageous effects of the addition of the release agent are produced. If the amount is more than 30% by weight, an effect is easily produced onto the charging characteristic or the toner is easily broken inside a developing unit. Thus, the release agent is spent into the carrier to lower the degree that the toner is electrified or to produce other effects.

The volume-average particle diameter of the wax particles in the release agent dispersion liquid is preferably 0.1 to 0.5 μm, more preferably 0.1 to 0.3 μm. If the volume-average particle diameter is more than 0.5 μm, the particles expose their appearance easily onto the surface of the toner and therefore the powdery fluidity of the toner deteriorates or the filming thereof onto a photosensitive body or a developing member is easily caused. Moreover, there arise problems that the release agent particles are not enveloped in an aggregation step, or the release agent particles fall away in a combination step. In the case of yielding, in particular, a color toner, the OHP transmissivity thereof is decreased by irregular reflection when the particle size of the release agent is large. As a result, the color reproducibility also decreases. The volume-average particle diameter can be measured by use of, for example, the above-mentioned laser diffraction mode particle size distribution analyzer. If the volume-average particle diameter is less than 0.1 μm, sufficient releasability cannot be unfavorably given to the toner.

A dispersion medium used to disperse the release agent is preferably an aqueous medium, such as water, pure water or ion exchange water. A surfactant is used as a dispersing agent. The wax dispersion liquid used for the toner of the invention may be prepared by any method under any condition using a known dispersing means such as a media dispersing machine (for example, a ball mill, a sand mill or an attriter) or a high-pressure type dispersing machine (for example, a nanomizer, a micro-fluidizer, an Ultimaizer, or a Gaulin) as long as the method makes it possible to satisfy the above-mentioned particle diameter and amount.

—Colorant—

In the toner, a colorant is usually contained in an effective amount, for example, in an amount of about 1 to 15% by weight, preferably about 3 to 10% by weight of the toner. The colorant used in the production method of the invention is not particularly limited, and a known colorant may be used. The colorant can be appropriately selected in accordance with the purpose of the toner. About the colorant, one species may be used as a colorant, or two or more species of similar types may be mixed and used as a colorant. Two or more species of different types may be mixed and used as a colorant. Specific examples of the colorant include carbon blacks such as furnace black, channel black, acetylene black, and thermal black; inorganic pigments such as Indian red, aniline black, iron blue, titanium oxide, and magnetic powder; azo pigments such as Fast Yellow, Monoazo Yellow, Disazo Yellow, Pyrazolone Red, Chelate Red, Brilliant Carmines (3B, 6B and so on), and Para Brown; phthalocyanine pigments such as copper phthalocyanine, and metal-free phthalocyanine; and condensed polycycle based pigments such as Flavanthron Yellow, Dibromoanthrone Orange, Perylene Red, Quinacridon Red, and Dioxazine Violet.

Other specific examples of the colorant include Chromium Yellow, Hansa Yellow, Benzidine Yellow, Threne Yellow, Quinoline Yellow, Permanent Orange GTR, Pyrazolone Orange, Vulcan Orange, Watchung Red, Permanent Red, Du Pont Oil Red, Lithol Red, Rhodamine B Lake, Lake Red C, rose bengal, Aniline Blue, Ultramarine Blue, Chalcoyl Blue, Methylene Blue Chloride, Phthalocyanine Blue, Phthalocyanine Green, Malachite Green Oxalate, Para Brown, and other various pigments; and acridine, xanthene, azo, benzoquinone, azine, anthraquinone, dioxazine, thiazine, azomethine, indigo, thioindigo, phthalocyanine, aniline black, polymethine, triphenylmethane, diphenylmethane, thiazol, xanthene-based dyes and other various dyes. A black pigment or dye may be blended to such a colorant in such a degree that the transparency is not decreased. A disperse dye or an oil-soluble dye may be used.

A dispersion medium used to disperse the colorant is preferably an aqueous medium, such as water, pure water or ion exchange water. A surfactant is used as a dispersing agent. The colorant dispersion liquid used for the toner of the invention may be prepared by any method under any condition using a known dispersing means such as a media dispersing machine (for example, a ball mill, a sand mill or an attriter) or a high-pressure type dispersing machine (for example, an anomizer, a micro-fluidizer, an Ultimaizer, or a Gaulin) as long as the method makes it possible to satisfy the above-mentioned particle diameter and amount.

<Other Components>

Other components that can be used in the electrostatic latent image developing toner of the invention are not particularly limited, and can be appropriately selected in accordance with the purpose of the toner. Examples thereof include inorganic particles, organic particles, an electrification controlling agent, and other known additives.

The inorganic particles are used in order to improve the fluidity of the toner in general. Examples of the inorganic particles include silica, alumina, titanium oxide, barium titanate, magnesium titanate, calcium titanate, strontium titanate, zinc oxide, silica sand, clay, mica, wollastonite, diatomaceous earth, ceriumchloride, Indian red, chromiumoxide, cerium oxide, antimony trioxide, magnesium oxide, zirconium oxide, silicon carbide, and silicon nitride particles. Out of these particles, silica particles are preferred, and silica particles treated for gaining hydrophobicity are particularly preferred.

The average primary particle diameter (number-average particle diameter) of the inorganic particles is preferably in a range of 1 to 1000 nm, and the amount of the particles (externally added) is preferably 0.01 to 20 parts by weight for 100 parts by weight of the toner.

The organic particles are used to improve the cleanability and the transferring property or occasionally improve the charging characteristic in general. Examples of the organic particles include polystyrene, polymethyl methacrylate, polyvinylidene fluoride, and polystyrene-acrylic copolymer particles.

The electrification controlling agent is generally used to improve the charging characteristic. Examples thereof include salicylic acid metal salts, metal-containing azo compounds, nigrosine, and quaternary ammonium salts.

<Characteristics of the Toner>

The volume-average particle diameter of the toner of the present exemplary embodiment is preferably 1 to 12 μm, more preferably 3 to 9 μm, even more preferably 3 to 8 μm. The number-average particle diameter of the toner in the exemplary embodiment is preferably 1 to 10 μm, more preferably 2 to 8 μm. If the particle diameter is too small, the productivity may be unstable, the charging characteristic may be insufficient and the developability may decrease. If the particle diameter is too large, the resolution of the image decreases.

About the toner of the present exemplary embodiment, the volume-average particle size distribution index GSDv thereof is preferably 1.30 or less. The ratio of the volume-average particle size distribution index GSDv to the number-average particle size distribution index GSDp (GSDv/GSDp) is preferably 0.95 or more. If the volume-average particle size distribution index GSDv is more than 1.30, the resolution of the image may decrease. If the ratio of the volume-average particle size distribution index GSDv to the number-average particle size distribution index GSDp (GSDv/GSDp) is less than 0.95, the charging characteristic of the toner decreases, the toner is scattered, and fogging is generated to result in image defects.

In the present exemplary embodiment, the particle diameter of the toner, the value of the volume-average particle size distribution index GSDv, and that of the number-average particle size distribution index GSDp are measured and calculated as follows: First, the particle size distribution of the toner is measured by use of a Coulter Multisizer II (manufactured by Beckman Coulter, Inc.) measuring instrument, and about each of the volume of the individual toner particles and the number thereof, a cumulative distribution is drawn with respect to separated particle size ranges (channels) from the side of the smallest particle diameter. The particle diameter when the cumulative percentage becomes 16% is defined as the volume-average particle diameter D16% or the number-average particle diameter D16p. The particle diameter when the cumulative percentage becomes 50% is defined as the volume-average particle diameter D50% or the number-average particle diameter D50p. In the same way, the particle diameter when the cumulative percentage becomes 84% is defined as the volume-average particle diameter D84% or the number-average particle diameter D84p. In this case, the volume-average particle size distribution index GSDv is defined as the ratio of D84v to D16v, and the number-average particle size distribution index GSDp is defined as the ratio of D84p to D16p. When these relational expressions are used, the volume-average particle size distribution index GSDv and the number-average particle size distribution index GSDp can be calculated.

The electrification amount of the toner in the present exemplary embodiment is preferably 15 to 60 μC/g, more preferably 20 to 50 μC/g as the absolute value thereof. If the electrification amount is less than 15 μC/g, background soil (fogging) is easily generated. If the electrification amount is more than 60 μC/g, the density of the image decreases easily. In the toner of the invention, the ratio of the electrification amount in summer (high temperature and high humidity) to that in winter (low temperature and low humidity) is preferably 0.5 to 1.5, more preferably 0.7 to 1.3. If the ratio is out of the range, the dependency of the charging characteristic on the environment is high and therefore the stability of the electrification of the toner becomes insufficient. This is unfavorable from the viewpoint of practical use.

[Developer]

Hereinafter, the electrostatic latent image developer (hereinafter, also may be sometimes referred to as a developer) of the invention will be described.

The developer of the invention is not particularly limited as long as the developer contains the toner of the invention. The ingredient composition thereof can be appropriately selected in accordance with the purpose of the developer. When the toner is used alone, the developer of the invention is rendered a one-component developer. When the toner is used in combination with a carrier, the developer of the invention is rendered a two-component developer.

The carrier is not particularly limited, and may be a known carrier. Examples thereof are resin-covered carriers described in JP-A Nos. 62-39879, and 56-11461, and other known carriers.

A specific example of the carrier is a resin-covered carrier composed of a nucleus particle and a covering resin described below. The nucleus particle is made of ordinary iron powder, ferrite powder, a magnetite shaped substance, or the like. The volume-average particle diameter is about 30 to 200 μm.

Examples of the covering resin of the resin-covered carrier include homopolymers or copolymers each made from two or more monomers selected from styrenes such as styrene, p-chlorostyrene, and α-methylstyrene; α-methylenealiphatic acid monocarboxylic acids, such as methyl acrylate, ethyl acrylate, n-propyl acrylate, lauryl acrylate, 2-ethylhexyl acrylate, methyl methacrylate, and n-propyl methacrylate; lauryl methacrylate, 2-ethyl hexyl methacrylate; nitrogen-containing acrylic compounds such as dimethylaminoethyl methacrylate; vinylnitriles such as acrylonitrile, and methacrylonitrile; vinylpyridines such as 2-vinylpyridine, and 4-vinylpyridine; vinyl ethers such as vinyl methyl ether, and vinyl isobutyl ether; vinyl ketones such as vinyl methyl ketone, vinyl ethyl ketone, and vinyl isopropenyl ketone; olefins such as ethylene, and propylene; and fluorine-containing vinyl-based monomers such as vinylidene fluoride, tetrafluoroethylene, and hexafluoroethylene. Other examples thereof include silicone resins such as methylsilicone, and methylphenylsilicone; polyesters each containing bisphenol, glycol, or the like; epoxy resins; polyurethane resins; polyamide resins; cellulose resins; polyether resins; and polycarbonate resins. These resins may be used alone or in combination of two or more thereof. The coating amount of the covering resin is preferably about 0.1 to 10 parts by weight, more preferably about 0.5 to 3.0 parts by weight for 100 parts by weight of the nucleus particle.

For the production of the carrier, there can be used a heating type kneader, a heating type Henschel mixer, a UMmixer, or the like. In accordance with the amount of the covering resin, a heating type rolling fluidized bed, a heating type kiln, or the like can be used.

In the developer of the invention, the blending ratio between the toner and the carrier is not particularly limited, and can be appropriately selected in accordance with the purpose of the toner.

[Image Forming Apparatus]

FIG. 1 is a schematic structural view of an exemplary embodiment of the image forming apparatus of the invention.

In a printer 1 illustrated in FIG. 1, light for exposure generated in an exposure unit 12 on the basis of image data transmitted from the outside is radiated onto the surface of a photosensitive body 10, which has predetermined electric charges given from an electrification unit 11 and is rotated in the direction of an arrow A, thereby forming an electrostatic latent image. A developing unit 13 having a developing roll 134 contains a developer containing a toner and a magnetic carrier. The above-mentioned electrostatic latent image is developed with the toner, and the developed image obtained by the development is transferred onto a recording sheet, which is pulled out from a sheet tray 16 and then carried in the direction of an arrow B by a sheet carrying device 16*a*, by a transferring roll 14. The transferred image is fixed by a fixing unit 15 wherein the fixation temperature is set to about 100° C. In this way, an image is formed on the recording sheet. This printer 1 is a machine exclusive for forming monochrome images.

In the developing unit 13, the developer contained in a chassis 130 is carried between the rear side and the front side in FIG. 1, while the developer is stirred by two augers 131. The developing unit 13 is also equipped with a magnetic permeability sensor 132 for detecting the concentration of the toner in this chassis. In FIG. 1, a partitioning plate 130*a* for partitioning the two augers 131 is illustrated.

This printer 1 is also equipped with a toner container 20 for supplying the toner to the developing unit 13, a toner carrying unit 30, and a control unit 40 for controlling operations of these units. From the magnetic permeability sensor 132, a signal representing the magnetic permeability inside the chassis is inputted into the control unit 40.

When the toner concentration decreases to a value lower than a predetermined value in this printer 1, the toner carrying unit 30 supplies the toner contained in the toner container 20 to the developing unit 13. The toner carrying unit 30 has a pipe 31 and a helical member 32, arranged in the pipe, which is rotated to send the toner toward the developing unit. The toner carrying unit 30 receives instructions from the control unit 40 to rotate this helical member 31 independently of the augers 131 inside the developing unit, thereby enabling to carry the toner.

Figure 2:
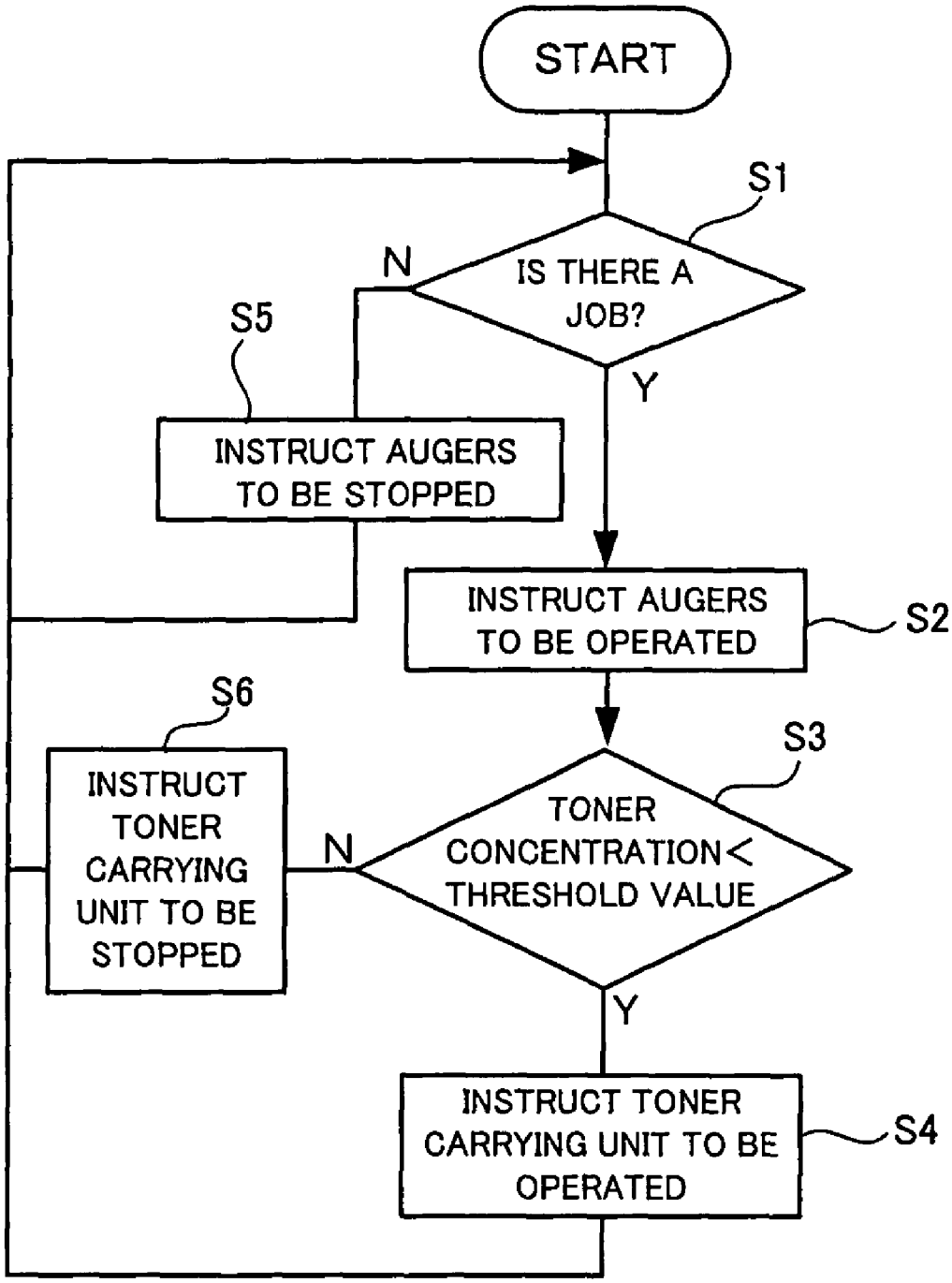
FIG. 2 is a flowchart of a routine performed in a control unit.

FIG. 2 is a flowchart of a routine performed in the control unit.

The routine shown in FIG. 2 is performed at the same time when a power source is turned on. In step S1, it is determined whether or not a print job is generated. When the job is generated, the present process proceeds to step S2, and then the augers 131 of the developing unit 13 are instructed to rotate. In step S3, it is determined whether or not the toner concentration detected on the basis of a signal from the magnetic permeability sensor 132 is below a threshold value set in advance. When it is determined that the toner concentration is below the threshold value in step S3, the process proceeds to step S4, and then the toner carrying unit 30 is instructed to cause the rotation of the helical member 32 to be started. Thereafter, the process returns to step S1. When it is determined that the toner concentration is equal to or more than the threshold value in step S3, the toner carrying unit 30 is instructed to cause the rotation of the helical member 32 to be stopped in step S6. The process then returns to step S1. On the other hand, when it is determined that no print job is present in step S1, the process proceeds to step S5 and then the augers 131 are instructed to be stopped. Thereafter, the process returns to step S1.

In this printer 1, the toner is a toner produced by the production method described below, in which a very good low-temperature fixability is exhibited and particles are suppressed from aggregating when the toner carrying unit 30 carries this toner.

Figure 3:
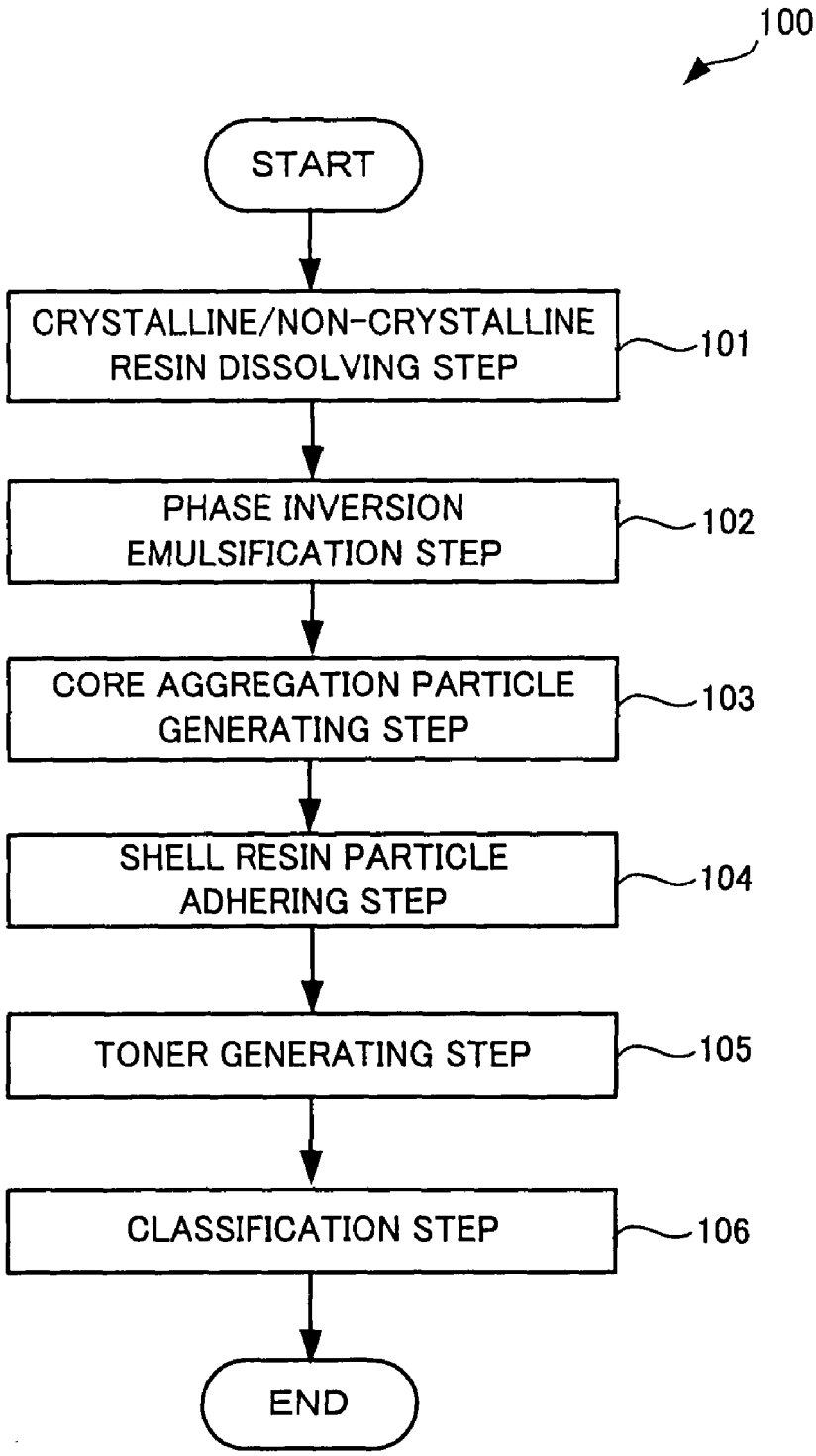
FIG. 3 is a flowchart showing an embodiment of the toner production method of the invention.

FIG. 3 is a flowchart showing an exemplary embodiment of the toner production method of the invention.

FIG. 3 shows steps of a toner production method 100 of the present exemplary embodiment. This toner production method 100 is composed of a crystalline/non-crystalline resin dissolving step 101 of dissolving, into a predetermined solvent, both of a crystalline resin about which an endothermic peak is detected by differential scanning calorimetry and a non-crystalline resin about which a stepwise change in endothermic amount is detected by differential scanning calorimetry; a phase inversion emulsification step 102 of converting the solvent in which both of the crystalline resin and the non-crystalline resin are dissolved in the crystalline/non-crystalline resin dissolving step 101 to a dispersion liquid wherein particles of the crystalline and non-crystalline resins are dispersed by phase inversion emulsification, a core aggregation particle generating step 103 of incorporating an aggregating agent and others into the dispersion liquid generated in the phase inversion emulsification step 102, thereby generating core aggregation particles in the dispersion liquid, a shell resin adhering step 104 of incorporating, into the dispersion liquid generated in the core aggregation particle generating step 103, a dispersion liquid wherein non-crystalline resin particles that are shell resin particles are dispersed, thereby adhering the non-crystalline resin particles onto the surface of the core aggregation particles, a toner generating step 105 of subjecting, to drying treatment and/or some other treatment, the core/shell resin aggregation particles that have a surface to which the shell resin particles are adhered and are generated in the non-crystalline resin adhering step 104, thereby generating a toner, and a classification step 106 of classifying the toner particles to set the ratio of the toner particles having an average particle diameter of 3 μm or less to 2% or less of the number of all of the toner particles.

In the above-mentioned toner production method 100, both of the crystalline resin and the non-crystalline resin are dissolved into the predetermined solvent and further the resultant is subjected to phase inversion emulsification in the crystalline/non-crystalline resin dissolving step 101 and the phase inversion classification step 102; therefore, it is possible to produce crystalline/non-crystalline mixed resin particles wherein the mixing of particles of the crystalline resin and those of the non-crystalline resin is further advanced than any method of dissolving the same crystalline resin and non-crystalline resin separately into predetermined solvents, mixing these solutions, and subjecting the resultant mixture to phase inversion emulsification. This makes it possible to suppress both of the following drawbacks: in the case that the complex elastic modulus measured at an angular frequency of 6.28 rad/sec., and a strain amount of 0.3% is $1\times10^6$ Pa or more and $1\times10^8$ Pa or less, the tangent loss is more than 1.8, whereby the viscosity of the toner increases when the toner is fixed and thereby the low-temperature fixability deteriorates; and in the same condition, the tangent loss is less than 0.5, whereby the toner becomes too soft and the toner particles aggregate easily. A toner having a characteristic that the tangent loss is 0.5 or more and 1.8 or less in the same condition can be produced. When the complex elastic modulus is $1\times10^6$ Pa or more and $1\times10^8$ Pa or less, the tangent loss is preferably 1.5 or less and 0.75 or more. This toner is one exemplary embodiment of the toner of the invention.

This toner is a toner having a volume-average particle diameter of about 6 μm, and the sizes of particles thereof are even since the toner particles are classified to set the ratio of the toner particles having a number particle diameter of 3 μm or less to 2% or less of the number of all of the toner particles in the classification step 106.

Accordingly, the following are suppressed although the printer 1 wherein a toner as described above is used has the fixing unit 13, wherein the fixation temperature is set to a low temperature (about 100° C.): the generation of poor fixation; and the generation of a poor image quality based on the aggregation of the toner particles when the toner is carried from the toner container 20 to the developing unit 13 by the toner carrying unit 30.

In this printer 1, the helical member 32 which is lower in driving frequency than the augers 131 are driven and controlled independently of the augers 131; therefore, in this case, the aggregation of the toner particles caused by a matter that the toner is pushed into the developing unit 13 more than necessary can be further suppressed than in the case of driving the helical member 32 and the augers 131 dependently on each other.

The following will describe experiments (Examples 1 to 6 and Comparative Examples 1 to 3) made to demonstrate the above-mentioned advantageous effects of the invention.

Examples 1 to 6 are experiments about low-temperature fixability and toner aggregation property. In the experiments, two combinations of a crystalline resin (crystalline resin 1 or 2) and a non-crystalline resin (non-crystalline resin 2) produced in the crystalline/non-crystalline resin dissolving step 101 described in FIG. 3 are each used as a core resin to prepare two types of toners. One of the these types of toners is subjected to each of three types of classification treatments to prepare three different types of toners. Totally five types of toners are prepared. These five types of toners are each used in a remodeled machine of a printer, DocuPrint C830 manufactured by Fuji Xerox Co., Ltd., wherein the printer as an exemplary embodiment of the image forming apparatus of the invention is embodied to examine the above-mentioned low-temperature fixability and toner aggregation property.

On the other hand, in Comparative Example 1, non-crystalline resin 1 is used as a core resin to prepare a toner, in Comparative Example 2, crystalline resin (2)/non-crystalline resin (1) produced by a method different from that used in the crystalline/non-crystalline resin dissolving step 101 described in FIG. 3 are used as core resins to prepare a toner, and in Comparative Example 3, crystalline resin (2) is used as a core resin to prepare a toner. Comparative Examples 1 to 3 are experiments about low-temperature fixability and toner aggregation property wherein the three types of toners are each used in a remodeled machine of a printer, DocuPrint C830 manufactured by Fuji Xerox Co., Ltd. Table 1 described below shows experiment conditions, experiment results, and estimations about each of Examples and Comparative Examples. In this remodeled machine, the fixing temperature according to the fixing unit could be freely set in the range of 20 to 200° C. In Examples 1 to 5 and Comparative Examples 1 to 3, the helical member for carrying a toner from the toner container to the developing unit in the remodeled machine is remodeled to drive dependently on the augers in the developing unit. In Example 6, the helical member, for carrying a toner from the toner container to the developing unit, is made to drive independently of the augers in the developing unit.

TABLE 1

| | Toner name | Core particle mother liquid | Core particle resin | Adhesive particle dispersion liquid | Adhesive particle resin | Independent driving | Tanδ minimum value | Tanδ maximum value |
|---|---|---|---|---|---|---|---|---|
| Example 1 | Ta | A1 | Crystalline (2), Non-crystalline (1) | C2 | Non-Crystalline (2) | Not performed | 0.56 | 1.36 |
| Example 2 | Tb | A2 | Crystalline (1) Non-crystalline (1) | C2 | Non-Crystalline (2) | Not performed | 0.89 | 1.12 |
| Example 3 | Tc | A2 | Crystalline (1), Non-crystalline (1) | C2 | Non-Crystalline (2) | Not performed | 0.89 | 1.12 |
| Example 4 | Td | A2 | Crystalline (1), Non-crystalline (1) | C2 | Non-Crystalline (2) | Not performed | 0.89 | 1.12 |
| Example 5 | Te | A2 | Crystalline (1), Non-crystalline (1) | C2 | Non-Crystalline (2) | Not performed | 0.89 | 1.12 |
| Example 6 | Te | A2 | Crystalline (1), Non-crystalline (1) | C2 | Non-Crystalline (2) | Performed | 0.89 | 1.12 |
| Comparative Example 1 | Tf | C1 | Non-crystalline (1) | C2 | Non-Crystalline (2) | Not performed | 1.25 | 2.26 |
| Comparative Example 2 | Tg | B1 + C1 | Crystalline (2), Non-crystalline (1) | C2 | Non-Crystalline (2) | Not performed | 0.42 | 1.39 |
| Comparative Example 3 | Th | B1 | Crystalline (2) | C2 | Non-Crystalline (2) | Not performed | 0.14 | 0.61 |

| | Classification | Ratio of particles having a particle diameter of 3 μm or less | Lowest fixing temperature | Evaluation | Colored dot generation ratio | Evaluation |
|---|---|---|---|---|---|---|
| Example 1 | Not performed | 3.34% | 106 | good | 0.45% | good |
| Example 2 | Not performed | 2.80% | 99 | very good | 0.10% | good |
| Example 3 | Performed | 2.25% | 99 | very good | 0.08% | good |
| Example 4 | Performed | 1.85% | 99 | very good | 0.05% | very good |
| Example 5 | Performed | 1.50% | 99 | very good | 0.02% | very good |
| Example 6 | Performed | 1.50% | 99 | very good | 0.01% | very good |
| Comparative Example 1 | Not performed | 4.50% | 130 | unallowable | 0.12% | good |

TABLE 1-continued

| | | | | | | |
|---|---|---|---|---|---|---|
| Comparative Example 2 | Not performed | 6.50% | 112 | allowable | 3.50% | unallowable |
| Comparative Example 3 | Not performed | 8.50% | 95 | very good | 10.30% | unallowable |

In the following description, toners are distinguished from each other by attaching the symbol T and a number to the inside of each round bracket "( )", crystalline/non-crystalline resin dispersion liquids are distinguished from each other by attaching the symbol A and a number to the inside of each round bracket "( )", crystalline resin dispersion liquids are distinguished from each other by attaching the symbol B and a number to the inside of each round bracket "( )", non-crystalline resin dispersion liquids are distinguished from each other by attaching the symbol C and a number to the inside of each round bracket "( )", and crystalline resins are distinguished from each other by attaching a number to the inside of each round bracket "( )", as well as non-crystalline resins.

Of the two types of toners produced on the basis of the two respective core resins prepared in accordance with the above-mentioned crystalline/non-crystalline resin dissolving step 101, toner (Ta) used in Example 1 will be described below.

—Production of Toner (Ta)—

(Preparation of Crystalline Resin (2))

First, into a three-neck flask are charged 100 parts by mass of dimethyl sebacate, 67.8 parts by mass of hexanediol, and 0.10 parts by mass of dibutyltin oxide, and the monomer components are caused to react at 180° C. for 6 hours in the nitrogen atmosphere while water generated during the reaction is removed out of the system. Thereafter, the temperature is raised to 210° C. while the pressure is gradually reduced to continue the reaction for 6 hours. Thereafter, the system is cooled to prepare crystalline resin (2) having a weight-average molecular weight of 32500.

(Preparation of Non-Crystalline Resin (1))

Into a three-neck flask are charged 49 parts by mass of dimethyl terephthalate, 72 parts by mass of dimethyl fumarate, 55 parts by mass of dodecenylsuccinic anhydride, 157 parts by mass of an ethylene oxide adduct of bisphenol A, 171 parts by mass of a propylene oxide adduct of bisphenol A, and 0.25 parts by mass of dibutyltin oxide, and the monomer components are caused to react at 180° C. for 3 hours in the nitrogen atmosphere while water generated during the reaction is removed out of the system. Thereafter, the temperature is raised to 240° C. while the pressure is gradually reduced to continue the reaction for 2 hours. Thereafter, the system is cooled to prepare non-crystalline resin (1) having a weight-average molecular weight of 18200.

(Preparation of a Colored Cyan Dispersion Liquid)

Mixed are 50 parts by mass of a cyan pigment (copper phthalocyanine B15:3, manufactured by Dainichiseika Color & Chemicals Mfg. Co., Ltd.), 5 parts by mass of a nonionic surfactant, Nonipol 400 (manufactured by Sanyo Chemical Industries, Ltd.), and 200 parts by mass of ion exchange water, and then a high-pressure impact disperser Ultimaizer (HJP 30006, manufactured by Sugino Machine Limited.) is used to disperse the pigment for about 1 hour, and then the water content therein is adjusted to prepare a colored cyan dispersion liquid.

(Preparation of a Release Agent Dispersion Liquid)

A solution wherein mixed are 60 parts by mass of a paraffin wax (HNP9, manufactured by Nippon Seiro Co., Ltd., melting temperature: 77° C.), an anionic surfactant (Neogen RK, manufactured by Dai-ichi Kogyo Siyaku Co., Ltd.), and 200 parts by mass of ion exchange water is heated to 120° C., and then a homogenizer (Ultra-Turrax T50, manufactured by IKA Co.) is used to disperse the wax. Thereafter, a Manton Gaulin high-pressure homogenizer (manufactured by Gaulin Co.) is used to subject the resultant dispersion liquid to dispersing treatment at 120° C. and 350 kg/cm$^2$ for 1 hour, to yield a release agent dispersion liquid wherein the release agent having a volume-average particle diameter of 250 nm is dispersed and the water content is adjusted to set the concentration of the release agent to 20% by mass.

(Preparation of Non-Crystalline Resin (2))

Into a three-neck flask are charged 39 parts by mass of dimethyl terephthalate, 80 parts by mass of dimethyl fumarate, 66 parts by mass of dodecenylsuccinic anhydride, 250 parts by mass of an ethylene oxide adduct of bisphenol A, 80 parts by mass of a propylene oxide adduct of bisphenol A, and 0.23 parts by mass of dibutyltin oxide, and the monomer components are caused to react at 180° C. for 3 hours in the nitrogen atmosphere while water generated during the reaction is removed out of the system. Thereafter, the temperature is raised to 240° C. to continue the reaction for 2 hours while the pressure is gradually reduced. Thereafter, the system is cooled to prepare non-crystalline resin (2) having a weight-average molecular weight of 16500.

(Production of Non-Crystalline Resin Dispersion Liquid (C2))

Into a three-neck flask are charged 100 parts by mass of non-crystalline resin (2) described above, 55 parts by mass of methyl ethyl ketone, and 23 parts by mass of n-propyl alcohol. While the solution is stirred, the resin is dissolved. Thereafter, 15 parts by mass of a 10% aqueous ammonium solution are added thereto, and further 350 parts by mass of ion exchange water are gradually added thereto to conduct phase inversion emulsification. Thereafter, the solvent is removed to produce non-crystalline resin dispersion liquid (C2) wherein non-crystalline resin particles having a volume-average particle diameter of 185 nm are dispersed and the solid concentration is 25%.

(Production of Crystalline/Non-Crystalline Mixed Resin Dispersion Liquid (A1))

Into a three-neck flask are charged 10 parts by mass of crystalline resin (2), 90 parts by mass of non-crystalline resin (1), 50 parts by mass of methyl ethyl ketone, and 15 parts by mass of isopropyl alcohol. While these components are stirred, the components are heated to 60° C. to dissolve the resins. Thereafter, 25 parts by mass of a 10% aqueous ammonium solution are added thereto, and further 400 parts by mass of ion exchange water are gradually added thereto to conduct phase inversion emulsification. Thereafter, the pressure is reduced to remove the solvent, thereby producing crystalline/non-crystalline mixed resin dispersion liquid (A1) wherein crystalline/non-crystalline mixed resin particles having a volume-average particle diameter of 158 nm are dispersed and the solid concentration is 25%.

(Production of Toner (Ta))

Into a round bottom flask made of stainless steel are charged 720 parts by mass of crystalline/non-crystalline mixed resin dispersion liquid (A1) described above, 50 parts by mass of the colorant dispersion liquid, 70 parts by mass of the release agent dispersion liquid, and 1.5 parts by mass of a cationic surfactant (Sanisol B50, manufactured by Kao Corp.), and then 0.1 N sulfuric acid is added thereto to adjust the pH to 3.8. Thereafter, thereto are added 30 parts by mass of an aqueous nitric acid solution containing polyaluminum chloride at a concentration of 10% by weight as an aggregating agent, and then a homogenizer (Ultra-Turrax T50, manufactured by IKA Co.) is used to disperse the solid components at 30° C. The system is heated to 40° C. at 1° C./minute in a heating oil bath, and is kept at 40° C. for 30 minutes. Thereafter, to this dispersion liquid are gently added 160 parts by mass of non-crystalline resin dispersion liquid (C2), and further the resultant is kept at the temperature for 1 hour.

Thereafter, 0.1 N sodium hydroxide solution is added thereto to adjust the pH to 7.0, and then the dispersion liquid is heated to 95° C. at 1° C./minute while the dispersion is continuously stirred. The system is kept at the temperature for 5 hours, and then cooled to 20° C. at a rate of 20° C./min. This is filtrated, and washed with ion exchange water, and dried by use of a vacuum drier to yield toner (Ta) wherein the volume-average particle diameter is 6.1 μm and the ratio of the number of particles having a diameter of 3 μm or less is 3.34%.

In this toner (Ta), the tangent loss is in the range of 0.56 or more and 1.36 or less when the complex elastic modulus measured at an angular frequency of 6.28 rad/sec., and a strain amount of 0.3% is $1\times10^6$ Pa or more and $1\times10^8$ Pa or less.

The complex elastic modulus is obtained from the dynamic viscoelasticity measured by a sinusoidal oscillation method, and the dynamic viscoelasticity is measured with an ARES measuring instrument manufactured by Reometric Scientific Co. The measurement of the dynamic viscoelasticity is made by setting a toner molded into a tablet into parallel plates having a diameter of 8 mm, and giving sinusoidal oscillation having a vibration frequency of 6.28 rad/sec. thereto after the normal force is set to zero. The measurement is started from 60° C. and is continued up to 150° C. The interval between measured times is set to 30 seconds, the temperature-raising rate is set to 1° C./min., and the strain amount is set to 0.3% to obtain the complex elastic modulus and the tangent loss.

In the measurement of the volume-average particle diameter, a Coulter Multisizer, model II (manufactured by Beckman Coulter, Inc.) is used, and an ISOTON-II (manufactured by Beckman Coulter, Inc.) is used as an electrolyte. A measurement target where a sample to be measured is dispersed is prepared in the following manner. To 2 mL of a 5% by weight aqueous sodium dodecylbenzenesulfonate solution, as a dispersing agent, is added a sample of 10 mg to be measured. This is added to 100 mL of the above-mentioned electrolyte. The electrolyte wherein the sample to be measured is suspended is subjected to dispersing treatment with an ultrasonic dispersing device for 1 minute. An aperture having an aperture diameter of 50 μm is used to measure the particle size distribution of particles having diameters of 1.0 to 3.0 μm by means of the Coulter Multisizer, model II, to obtain the volume-average distribution and the number-average distribution. About the measured distributions, a cumulative distribution by volume is drawn, from the side of the smallest diameter, on the basis of separated particle size ranges (channels). The particle diameter when the cumulative percentage became 50% (D50v) is defined as the volume-average particle diameter of the sample. Moreover, a cumulative distribution by number is drawn, from the side of the smallest diameter. The ratio of the number of particle shaving a particle diameter of 3 μm or less to the total number of the measured particles is defined as the ratio of the number of the particles having a particle diameter of 3 μm or less. This volume-average particle diameter and the ratio of the number of particles having a particle diameter of 3 μm or less can be measured by a software set up in the Coulter Multisizer, model II.

About each of the toners shown in Table 1, 1.2 parts by mass of commercially available fumed silica RX 50 (manufactured by Nippon Aerosil Co., Ltd.) as an external additive are added thereto by use of a Henschel mixer (manufactured by Mitsui Miike Machinery Co., Ltd.) at a peripheral speed of 30 m/s for 5 minutes. Furthermore, 8 parts by mass of the toner, to which the external additive is added, and 100 parts by mass of a carrier are mixed to produce a two-component developer. The carrier is obtained by stirring 14 parts by mass of toluene, 2 parts by mass of a styrene/methyl methacrylate copolymer (ratio of styrene to methyl methacrylate: 90/10, and weight-average molecular weight Mw: 80000), and 0.2 parts by mass of carbon black (R330, manufactured by Cabot Co.) for 10 minutes to prepare a coating solution wherein the solid components are dispersed, putting this coating solution and 100 parts by mass of ferrite particles (volume-average particle diameter: 50 μm) into a vacuum degassing kneader (manufactured by Inoue Manufacturing Co., Ltd.), stirring the mixture at 60° C. for 30 minutes, degassing the kneader under reduced pressure while heating the mixture, drying the resultant, and then classifying the resultant particles based on a size of 105 μm set as a border.

Out of the two toners produced on the basis of the two respective core resins prepared in accordance with the above-mentioned crystalline/non-crystalline resin dissolving step 101, toner (Tb) used in Example 2 will be described below.

—Production of Toner (Tb)—

(Preparation of Crystalline Resin (1))

First, into a three-neck flask are charged 100 parts by mass of dimethyl decanoate, 75.0 parts by mass of 1,9-nonanediol, and 0.08 parts by mass of dibutyltin oxide, and the monomer components are caused to react at 180° C. for 8 hours in the nitrogen atmosphere while water generated during the reaction is removed out of the system. Thereafter, the temperature is raised to 230° C. to continue the reaction for 7 hours while the pressure is gradually reduced. Thereafter, the system is cooled to prepare crystalline resin (1) having a weight-average molecular weight of 22500.

(Production of Crystalline/Non-Crystalline Mixed Resin Dispersion Liquid (A2))

Into a three-neck flask are charged 10 parts by mass of crystalline resin (1), 90 parts by mass of non-crystalline resin (1) described above, 45 parts by mass of methyl ethyl ketone, and 20 parts by mass of isopropyl alcohol. While these components are stirred, the components are heated to 60° C. to dissolve the resins. Thereafter, 25 parts by mass of a 10% aqueous ammonium solution are added thereto, and further 400 parts by mass of ion exchange water are gradually added thereto to conduct phase inversion emulsification. Thereafter, the pressure is reduced to remove the solvent, thereby producing crystalline/non-crystalline mixed resin dispersion liquid (A2) wherein crystalline/non-crystalline resin mixed resins particles having a volume-average particle diameter of 124 nm are dispersed and the solid concentration is 25%.

(Production of Toner (Tb))

Into a round bottom flask made of stainless steel are charged 600 parts by mass of crystalline/non-crystalline mixed resin dispersion liquid (A2) described above, 50 parts by mass of the colorant dispersion liquid, 70 parts by mass of the release agent dispersion liquid, and 1.5 parts by mass of a cationic surfactant (Sanisol B50, manufactured by Kao Corp.), and then 0.1 N sulfuric acid is added thereto to adjust the pH to 3.7. Thereafter, thereto are added 30 parts by mass of an aqueous nitric acid solution containing polyaluminum chloride at a concentration of 10% by weight as an aggregating agent, and then a homogenizer (Ultra-Turrax T50, manufactured by IKA Co.) is used to disperse the solid components at 30° C. The system is heated to 45° C. at 1° C./minute in a heating oil bath, and is kept at 45° C. for 2 hours. Thereafter, to this dispersion liquid are gently added 280 parts by mass of non-crystalline resin dispersion liquid (C2), and further the resultant is kept at the temperature for 1 hour.

Thereafter, 0.1 N sodium hydroxide solution is added thereto to adjust the pH to 7.5, and then the dispersion liquid is heated to 90° C. at 1° C./minute while the dispersion is continuously stirred. The system is kept at the temperature for 3 hours, and then cooled to 20° C. at a rate of 20° C./min. This is filtrated, and washed with ion exchange water, and dried by use of a vacuum drier to yield toner (Tb) wherein the volume-average particle diameter is 6.3 μm and the ratio of the number of particles having a diameter of 3 μm or less is 2.80%.

In this toner (Tb), the tangent loss is in the range of 0.89 or more and 1.12 or less when the complex elastic modulus measured at an angular frequency of 6.28 rad/sec., and a strain amount of 0.3% is $1\times10^6$ Pa or more and $1\times10^8$ Pa or less.

In Examples 3, 4 and 5, toners (Tb) subjected to the different classification treatments are used. Accordingly, toner (Tb) used in Example 2 had a volume-average particle diameter of 6.3 μm and the ratio of particles having a diameter of 3 μm or less is 2.80% while toner (Tc) used in Example 3 had a volume-average particle diameter of 5.7 μm and the ratio of particles having a diameter of 3 μm or less is 2.25%, toner (Td) used in Example 4 had a volume-average particle diameter of 5.6 μm and the ratio of particles having a diameter of 3 μm or less is 1.85%, and toner (Te) used in Example 5 had a volume-average particle diameter of 5.5 μm and the ratio of particles having a diameter of 3 μm or less is 1.5%. In Example 6, the same toner (Te) as used in Example 5 is used.

In the classification treatments, an Elbow Jet Classifier (EJ-Labo, manufactured by Nittetsu Mining Co., Ltd.) is used.

Toner (Tf) used in Comparative Example 1 will be described below.

—Production of Toner (Tf)—

(Production of Non-Crystalline Resin Dispersion Liquid (C1))

First, into a three-neck flask are charged 100 parts by mass of non-crystalline resin (1) described above, 50 parts by mass of ethylacetate, and 20 parts by mass of n-propyl alcohol. While these components are stirred, the resin is dissolved. Thereafter, 12 parts by mass of a 10% aqueous ammonium solution are added thereto, and further 350 parts by mass of ion exchange water are gradually added thereto to conduct phase inversion emulsification. Thereafter, the solvent is removed to produce non-crystalline resin dispersion liquid (C1) wherein non-crystalline resin particles having a volume-average particle diameter of 123 nm are dispersed and the solid concentration is 25%.

(Production of Toner (Tf))

Into a round bottom flask made of stainless steel are charged 720 parts by mass of non-crystalline resin dispersion liquid (C1) described above, 50 parts by mass of the colorant dispersion liquid, 70 parts by mass of the release agent dispersion liquid, and 1.5 parts by mass of a cationic surfactant (Sanisol B50, manufactured by Kao Corp.), and then 0.1N sulfuric acid is added thereto to adjust the pH to 3.2. Thereafter, thereto are added 20 parts by mass of an aqueous nitric acid solution containing polyaluminum chloride at a concentration of 10% by weight as an aggregating agent, and then a homogenizer (Ultra-Turrax T50, manufactured by IKA Co.) is used to disperse the solid components at 30° C. The system is heated to 52° C. at 1° C./minute in a heating oil bath, and is kept at 52° C. for 3 hours. Thereafter, to this dispersion liquid are gently added 160 parts by mass of non-crystalline resin dispersion liquid (C2) described above, and further the resultant is kept at the temperature for 1 hour.

Thereafter, 0.1 N sodium hydroxide solution is added thereto to adjust the pH to 7.5, and then the dispersion liquid is heated to 90° C. at 1° C./minute while the dispersion is continuously stirred. The system is kept at the temperature for 4 hours, and then cooled to 20° C. at a rate of 20° C./min. This is filtrated, and washed with ion exchange water, and dried by use of a vacuum drier to yield toner (Tf) wherein the volume-average particle diameter is 5.9 μm and the ratio of the number of particles having a diameter of 3 μm or less is 4.5%.

In this toner (Tf), the tangent loss is in the range of 1.25 or more and 2.26 or less when the complex elastic modulus measured at an angular frequency of 6.28 rad/sec., and a strain amount of 0.3% is $1\times10^6$ Pa or more and $1\times10^8$ Pa or less.

Toner (Tg) used in Comparative Example 2 will be described below.

—Production of Toner (Tg)—

(Production of Crystalline Resin Dispersion Liquid (B1))

First, into a three-neck flask are charged 100 parts by mass of crystalline resin (2) described above, 40 parts by mass of ethyl acetate, and 20 parts by mass of n-propyl alcohol. These components are stirred and heated to 55° C. to dissolve the resin. Thereafter, 19 parts by mass of a 1 N solution of potassium hydroxide in water are added thereto, and further 400 parts by mass of ion exchange water are gradually added thereto to conduct phase inversion emulsification. Thereafter, the solvent is removed to produce crystalline resin dispersion liquid (B1) which is a dispersion liquid wherein resin particles having a volume-average particle diameter of 255 nm are dispersed and the solid concentration is 20%.

(Production of Toner (Tg))

Into a round bottom flask made of stainless steel are charged 72 parts by mass of crystalline resin dispersion liquid (B1) described above, 648 parts by mass of noncrystalline resin dispersion liquid (C1), 50 parts by mass of the colorant dispersion liquid, 70 parts by mass of the release agent dispersion liquid, and 1.5 parts by mass of a cationic surfactant (Sanisol B50, manufactured by Kao Corp.), and then 14 parts by mass of an aqueous nitric acid solution containing polyaluminum chloride at a concentration of 10% by weight as an aggregating agent are added thereto. Thereafter, a homogenizer (Ultra-TurraxT50, manufactured by IKA Co.) is used to disperse the solid components at 30° C. The system is heated to 40° C. at 1° C./minute in a heating oil bath, and is kept at 40° C. for 30 minutes. Thereafter, to this dispersion liquid are gently added 160 parts by mass of non-crystalline resin dispersion liquid (C2) described above, and further the resultant is kept at the temperature for 2 hours.

Thereafter, 0.1 N sodium hydroxide solution is added thereto to adjust the pH to 9.0, and then the dispersion liquid is heated to 85° C. at 1° C./minute while being continuously stirred. The system is kept at the temperature for 3 hours, and then cooled to 20° C. at a rate of 20° C./min. This is filtrated, and washed with ion exchange water, and dried by use of a vacuum drier to yield toner (Tg) wherein the volume-average particle diameter is 5.7 μm and the ratio of the number of particles having a diameter of 3 μm or less is 6.5%.

In this toner (Tg), the tangent loss is in the range of 0.42 or more and 1.39 or less when the complex elastic modulus measured at an angular frequency of 6.28 rad/sec., and a strain amount of 0.3% is $1\times10^6$ Pa or more and $1\times10^8$ or less.

(Production of Toner (Th))

Toner (Th) used in Comparative Example 3 is produced by the following method:

Into a round bottom flask made of stainless steel are charged 720 parts by mass of crystalline resin dispersion liquid (B1) described above, 100 parts by mass of the colorant dispersion liquid, 70 parts by mass of the release agent dispersion liquid, and 1.5 parts by mass of a cationic surfactant (Sanisol B50, manufactured by Kao Corp.), and then 14 parts by mass of an aqueous nitric acid solution containing polyaluminum chloride at a concentration of 10% by weight as an aggregating agent are added thereto. Thereafter, a homogenizer (Ultra-Turrax T50, manufactured by IKA Co.) is used to disperse the solid components at 30° C. The system is heated to 38° C. at 1° C./minute in a heating oil bath, and is kept at 38° C. for 30 minutes. Thereafter, to this dispersion liquid are gently added 110 parts by mass of non-crystalline resin dispersion liquid (C2) described above, and further the resultant is kept at the temperature for 1 hour.

Thereafter, 0.1 N sodium hydroxide solution is added thereto to adjust the pH to 9.5, and then the dispersion liquid is heated to 80° C. at 1° C./minute while the dispersion is continuously stirred. The system is kept at the temperature for 30 minutes, and then cooled to 20° C. at a rate of 20° C./min. This is filtrated, and washed with ion exchange water, and dried by use of a vacuum drier to yield toner (Th) wherein the volume-average particle diameter is 5.9 μm and the ratio of the number of particles having a diameter of 3 μm or less is 8.50%.

In this toner (Th), the tangent loss is in the range of 0.14 or more and 0.61 or less when the complex elastic modulus measured at an angular frequency of 6.28 rad/sec., and a strain amount of 0.3% is $1\times10^6$ Pa or more and $1\times10^8$ Pa or less.

(Evaluation)

About evaluation of the low-temperature fixability of the toners of these Examples and Comparative Examples, attention is paid to their lowest fixing temperatures. The above-mentioned DocuPrint C830 remodeled machine is adjusted to set the toner amount on a paper sheet (J paper, manufactured by Fuji Xerox Co., Ltd.) to 4.8 g/m$^2$, and then cyan colored images, 25 mm×25 mm in size, which are not fixed are prepared about each of Examples 1 to 6 and Comparative Examples 1 to 3. The sheet, on which the unfixed images are formed, is used, and the images are fixed while the fixation temperature in the fixing unit is stepwise raised from 70 to 200° C. About fixed images prepared when values of the fixing temperature are values in the range of 70 to 200° C., offset is evaluated with the naked eye. The temperature at which offset came not to be generated is specified and estimated. About criteria for evaluating the lowest fixing temperature, a case wherein the temperature is lower than 100° C. is judged as "very good", a case where the temperature is 100° C. or higher and lower than 110° C. is judged as "good", a case where the temperature is 110° C. or higher and lower than 120° C. is judged as "allowable", and a case where the temperature is 120° C. or higher is judged as "unallowable".

About evaluation of the aggregation property of the toners, attention is paid to their colored dot generation rates. About each of Examples 1 to 6 and Comparative Examples 1 to 3, a halftone image (toner amount: 1.6 g/m$^2$) is continuously copied and outputted onto 20000 sheets, and the generation rate of one or more colored dots, 0.3 mm or more in size, generated on the image on each of the sheets is evaluated based on: the colored dot generation rate (%)=(the number of sheets on which one or more colored dots of 0.3 mm or more in size are generated)/(the number of the image-outputted sheets)×100. About the criterion for evaluating the colored dot generation rate, a case where the rate is less than 0.06% is judged as "very good", a case where the rate is 0.06% or more and less than 0.50% is judged as "good", a case where the rate is 0.5% or more and less than 3.5% is judged as "allowable", and a case where the rate is 3.5% or more is judged as "unallowable".

Table 1 demonstrates that about Examples 1 to 6, wherein toners (Ta) to (Te) produced by the toner production method 100, which is an exemplary embodiment of the toner production method of the invention is used, low-temperature fixation is realized and further the aggregation of the toner particles is suppressed. Thus, the lowest fixing temperatures and the colored dot generation rates are judged as "good" or "very good". In Example 6, which is different from Example 5, the helical member for carrying a toner from the toner container to the developing unit is made to be controlled independently of the stirring member in the developing unit, whereby the aggregation of the toner particles is further suppressed. Thus, it is understood that in Example 6, the colored dot generation rate is made smaller than in Example 5.

It is also understood that in Examples 3 to 5, the colored dot generation rate is lower as the toner particle size distribution is made narrower by the classification treatments.

Furthermore, in Example 1 and Comparative Example 2, the resin structures of the core aggregation particles are the same but the degrees of the mixing of the resins are different in accordance with the difference between the production methods thereof; therefore, in Comparative Example 2, the minimum value of the tangent loss is less than 0.5 in the complex elastic modulus range of $1\times10^6$ Pa or more $1\times10^8$ Pa or less. As a result, in Comparative Example 2, the toner is slightly soft, and the colored dot generation rate is judged as "unallowable". In Comparative Example 1, the maximum value of the tangent loss is more than 1.8 in the complex elastic modulus range of $1\times10^6$ Pa or more $1\times10^8$ Pa or less. As a result, the lowest fixing temperature is judged as "unallowable". In Comparative Example 3, the minimum value of the tangent loss is considerably smaller than 0.5 in the complex elastic modulus range of $1\times10^6$ Pa or more $1\times10^8$ Pa or less. Thus, the colored dot generation rate is judged as "unallowable".

According to the above-mentioned results, it is proved that in the printer 1 using a toner produced by the toner production method 100, it is possible to suppress the generation of inconveniences about the fixation of toner images and to suppress the generation of poor image quality based on the aggregation of toner particles when the toner is carried from the toner container 20 to the developing unit 13 by the toner carrying unit 30 although the printer 1 has the fixing unit 13, wherein the fixation temperature is set to a low temperature (about 100° C.).

Figure 4:
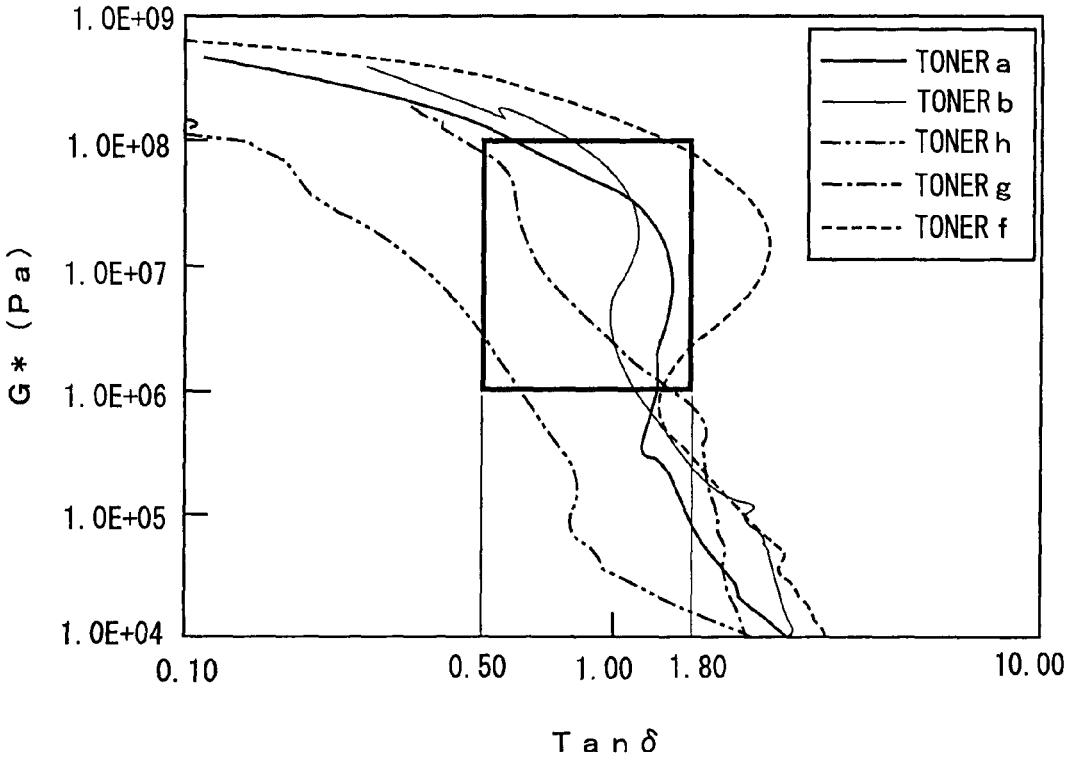
FIG. 4 is a graph showing a relationship between the complex elastic modulus and the tangent loss (Tan δ) of each of toners used in Examples and Comparative Examples.

FIG. 4 is a graph showing a relationship between the complex elastic modulus and the tangent loss (Tan δ) of each of the toners used in Examples and Comparative Examples.

In FIG. 4 are shown a relationship between the complex elastic modulus and the tangent loss (Tan δ) of each of toner (Ta) used in Example 1, toner (Tb) used in Example 2, toner (Tf) used in Comparative Example 1, toner (Tg) used in Comparative Example 2, and toner (Th) used in Comparative Example 3.

In FIG. 4, a black frame represents a range that the tangent loss (Tan δ) is 0.50 or more and 1.8 or less in the range that the absolute value of the complex elastic modulus is $1\times10^6$ Pa or more and $1\times10^8$ Pa or less. FIG. 4 demonstrates that only about toner (Ta) and toner (Tb), the tangent loss (Tan δ) shifts in the range of 0.50 or more and 1.8 or less in the range that the absolute value of the complex elastic modulus is $1\times10^6$ Pa or more and $1\times10^8$ Pa or less.

In the above-mentioned exemplary embodiment, exemplified is the case that the helical member 32 for carrying a toner from the toner container 20 to the developing unit 13 is controlled independently of the augers inside the developing unit; however, the invention is not limited to this case. Thus, the helical member and the augers may be controlled to drive dependently on each other. Moreover, the toner production method has the classification step; however, in the invention, the method may not have this classification step.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling other skilled in the art to understand the invention for various embodiments and with the various modifications as are suited to the particular use contemplated. It is intended that the scope of the invention be defined by the following claims and their equivalents.

What is claimed is:

1. A toner wherein: when the complex elastic modulus measured at an angular frequency of 6.28 rad/sec., and a strain amount of 0.3% is $1\times10^6$ Pa or more and $1\times10^8$ Pa or less, the tangent loss is 0.5 or more and 1.8 or less.

2. The toner according to claim 1, comprising a crystalline resin and a non-crystalline resin, wherein the acid value of the crystalline resin is 5 to 50 mgKOH/g, and the acid value of the non-crystalline resin is 10 to 50 mgKOH/g.

3. The toner according to claim 2, wherein the melting temperature of the crystalline resin in accordance with ASTM D3418-8 is 50 to 100° C., and the glass transition temperature (Tg) of the non-crystalline resin is 50 to 65° C.

4. The toner according to claim 2, wherein the weight-average molecular weight (Mw) of the crystalline resin is 8,000 to 35,000 and the weight-average molecular weight (Mw) of the non-crystalline resin is 20,000 to 50,000.

5. The toner according to claim 2, wherein the ratio by weight of the crystalline resin to the non-crystalline resin is 5/95 to 40/60.

6. The toner according to claim 2, wherein the softening temperature of the non-crystalline resin is 60 to 90° C.

7. The toner according to claim 2, wherein the crystalline resin is a crystalline aliphatic polyester resin having an alkyl group having 6 or more carbon atoms.

8. The toner according to claim 7, wherein the acid component of the crystalline polyester comprises a dodecenylsuccinic acid component.

9. The toner according to claim 1, comprising a release agent, wherein the amount of the release agent is 0.5 to 30% by weight with respect to the total amount of the toner.

10. The toner according to claim 1, having a volume-average particle size distribution index GSDv of 1.30 or less.

11. A method of producing the toner recited in claim 1, the method comprising:

dissolving, into a predetermined solvent, both of a crystalline resin about which an endothermic peak is detected by differential scanning calorimetry and a non-crystalline resin about which a stepwise change in endothermic amount is detected by differential scanning calorimetry, thereby obtaining a resin solution;

generating toner particle nuclei by subjecting the resin solution obtained in the dissolving to phase inversion emulsification; and generating toner particles on the basis of the nuclei obtained in the generating of the toner particle nuclei.

12. The method according to claim 11, further comprising classifying the toner particles.

13. A developer comprising:

a toner wherein when the complex elastic modulus measured at an angular frequency of 6.28 rad/sec., and a strain amount of 0.3% is $1\times10^6$ Pa or more and $1\times10^8$ Pa or less, the tangent loss is 0.5 or more and 1.8 or less; and a carrier.

14. The developer according to claim 13, wherein the carrier comprises a nucleus particle and a covering resin.

15. The developer according to claim 14, wherein the amount of the covering resin is 0.1 to 10 parts by weight for 100 parts by weight of the nucleus particle.

16. The developer according to claim 14, wherein the covering resin obtained by polymerizing a polymerizable monomer having a vinyl double bond.

17. An image forming apparatus comprising:

an image holding body that holds an image formed on a surface of the image holding body;

an image forming unit that forms an image on the surface of the image holding body by a toner wherein when the complex elastic modulus measured at an angular frequency of 6.28 rad/sec. and a strain amount of 0.3% is $1\times10^6$ Pa or more and $1\times10^8$ Pa or less, the tangent loss is 0.5 or more and 1.8 or less;

a transferring unit that transfers the image held on the image holding body to a transferred object; and a fixing unit that fixes the transferred image.

* * * * *